US005122175A

United States Patent [19]

Koyama et al.

[11] Patent Number: 5,122,175

[45] Date of Patent: Jun. 16, 1992

[54] METHOD OF AND APPARATUS FOR PRODUCING SUPERPURE NITROGEN

[75] Inventors: Shozi Koyama, Yamaguchi; Takazumi Ishizu, Hikari; Junichi Hosokawa; Masahiro Yamazaki, both of Kudamatsu; Shinjiroo Ueda, Abiko; Kanji Fujimori, Kudamatsu, all of Japan

[73] Assignee: Hitachi, Ltd., Tokyo, Japan

[21] Appl. No.: 531,249

[22] Filed: May 31, 1990

[30] Foreign Application Priority Data

| | | | |
|---|---|---|---|
| Jun. 2, 1989 | [JP] | Japan | 1-139043 |
| Sep. 4, 1989 | [JP] | Japan | 1-227392 |
| Sep. 4, 1989 | [JP] | Japan | 1-227393 |
| Feb. 14, 1990 | [JP] | Japan | 2-12778 |

[51] Int. Cl.[5] ..... F25J 3/00; F25J 3/02

[52] U.S. Cl. ..... 62/38; 62/44; 62/31; 62/32; 62/24; 62/17

[58] Field of Search ..... 62/17, 19, 21, 23, 24, 62/27, 31, 32, 38, 44

[56] References Cited

U.S. PATENT DOCUMENTS

| | | | |
|---|---|---|---|
| 2,968,160 | 1/1961 | Schilling et al. | 62/44 X |
| 3,181,306 | 5/1965 | Geist et al. | 52/19 X |
| 4,152,130 | 5/1979 | Theobald | 62/38 X |
| 4,202,678 | 5/1980 | Hvizdos | 62/38 |
| 4,289,515 | 9/1981 | Yearout | 62/38 X |
| 4,617,037 | 10/1986 | Okada et al. | 62/38 X |
| 4,617,040 | 10/1986 | Yoshino | 62/44 X |
| 4,671,813 | 6/1987 | Yoshino | 62/32 |
| 4,834,785 | 5/1989 | Ayres | 62/38 |
| 4,853,015 | 8/1989 | Yoshino | 62/24 X |

*Primary Examiner*—Henry A. Bennet
*Assistant Examiner*—Christopher B. Kilner
*Attorney, Agent, or Firm*—Antonelli, Terry, Stout & Kraus

[57] ABSTRACT

The present invention consists in that a nitrogen gas line and a liquid nitrogen line are subjected to hot-blast baking with clean nitrogen gas and a gas containing oxygen, whereby outgasses such as moisture to develop from heat exchangers, valves and piping can be excluded. Moreover, in order to obtain nitrogen gas of very high purity, liquid nitrogen of low contents of high-boiling components as subjected to rectifying separation is derived and gasified, and the liquid nitrogen is introduced into co-adsorbers so as to absorb and remove carbon monoxide difficult of separation by the rectifying separation, whereupon the liquid nitrogen and the nitrogen gas are obtained as products.

28 Claims, 4 Drawing Sheets

METHOD OF AND APPARATUS FOR PRODUCING SUPERPURE NITROGEN

BACKGROUND OF THE INVENTION

2. Field of the Invention

The present invention relates to the production of nitrogen, and more particularly to a nitrogen producing method and apparatus which are well suited to produce superpure nitrogen with a low impurity content.

2. Description of the Prior Art

In recent years, superpure nitrogen containing very little impurities has been increasingly demanded for use in, for example, the fabrication of submicron LSIs. A nitrogen producing apparatus which has been generally known is disclosed in the Official Gazette of Japanese Patent Application Laid-Open No. 84888/1979 or No. 225568/1986 or U.S. Pat. No. 4,617,040. In such apparatus feed air is cooled to a low temperature and is thereafter subjected to rectifying separation by a rectifying column. Then the separated that nitrogen gas is taken from the upper part of a rectifying column Then, the separated nitrogen gas has its temperature restored to the normal temperature by an air heat exchanger, and the resulting gas is obtained as product nitrogen.

Further, in such nitrogen producing apparatus, carbon monoxide and hydrogen are removed by catalytic burning. Remaining hydrogen is also separated and removed by gas blows from the top of the rectifying column and particles are removed by inserting a filter in a liquid nitrogen line.

The nitrogen producing apparatus in the prior art does not take into consideration the need to remove impurities such as moisture. Accordingly, it has a drawback that the moisture and other outgases contained in the heat exchanger, piping, valves etc. mix into the nitrogen product in the process of removing the impurities, such as oxygen, carbon dioxide, hydrocarbon and moisture, to the order of ppb by means of the rectifying column, drawing the nitrogen gas at the low temperature out of the upper part of the rectifying column, and thereafter restoring the temperature to the normal temperature by means of the air heat exchanger.

Moreover, the construction of the nitrogen producing apparatus in the prior art does not take into consideration the need to remove low-boiling impurities such as carbon monoxide and hydrogen to the order of ppb. In this regard, the removal of the carbon monoxide resulting from on the catalytic burning is due to the short lifetime of a catalyst which is attributed to the deterioration of the catalyst. Besides, in the separation and removal of the hydrogen, only the gas blows from the top of the rectifying column are performed, and the number of rectifying stages which is necessary for the rectifying separation are not provided, so that the carbon monoxide and the hydrogen cannot be removed to an order of several ppb. In addition, regarding the removal of the particles, particles having diameters of 0.1 μm cannot be reduced to several particles/ft$^3$ or less because the filter is not incorporated in the liquid nitrogen line.

SUMMARY OF THE INVENTION

An object of the present invention is to solve the drawbacks mentioned above, and to provide a method of and apparatus for producing superpure nitrogen, capable of producing the nitrogen of very high purity in which the contents of impurities such as oxygen, carbon dioxide, hydrocarbon, moisture, carbon monoxide and hydrogen is on the order of several ppb or less, and in which particles having diameters of 0.01 μm are at a density or concentration of several particles/ft$^3$ or less.

DESCRIPTION OF THE EMBODIMENTS

Figure 1:
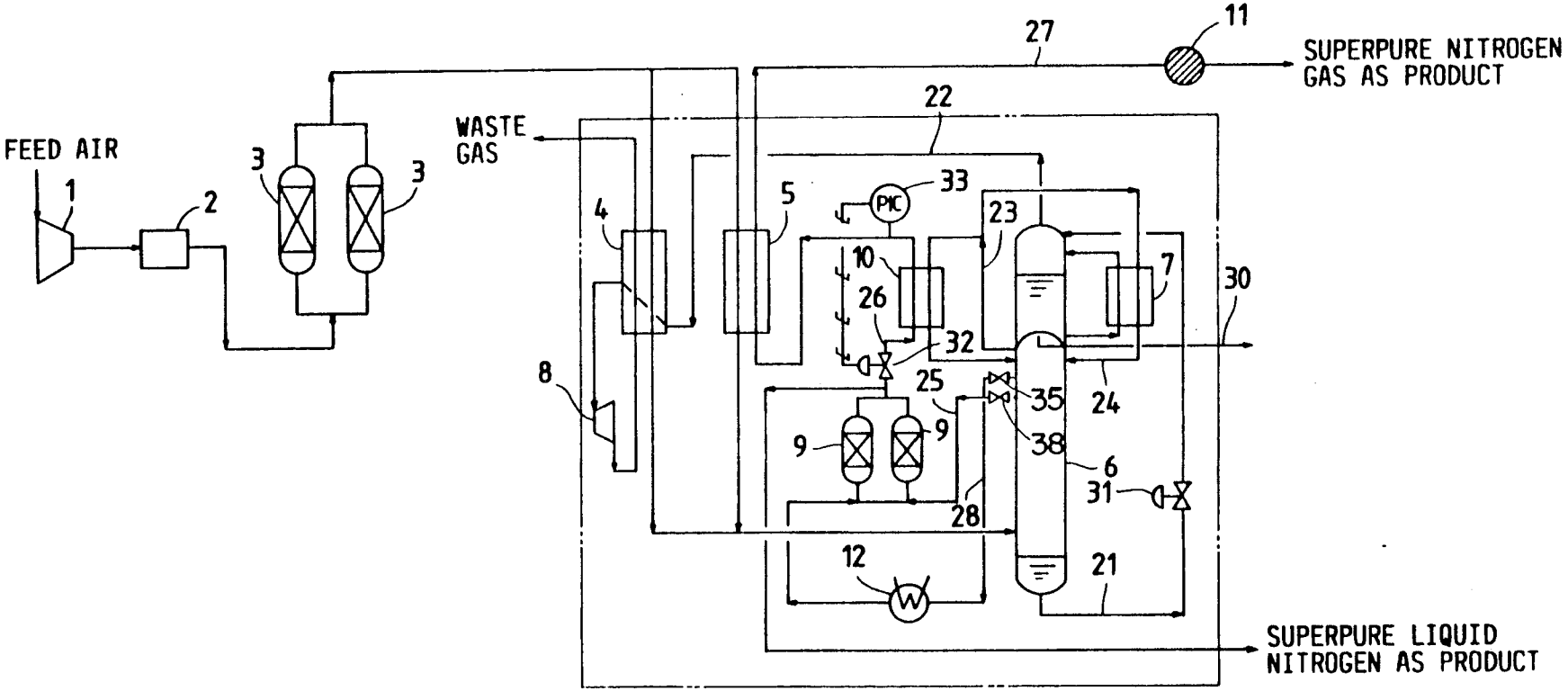
FIG. 1 is a flow sheet of an apparatus for producing superpure nitrogen in an embodiment of the present invention.

Now, one embodiment of the present invention will be described with reference to FIG. 1.

Referring to this figure, feed air taken in from the atmospheric air is compressed to about 9.8 kg/cm$^2$G by an air compressor 1. Via a $CO/H_2$ catalyzer 2 which is employed in order to lessen impurities (especially, carbon monoxide and hydrogen) contained in the feed air, the compressed air is introduced into adsorbers 3 where moisture and carbonic acid gas are removed by adsorption. The resulting feed air from the adsorbers 3 is bifurcated to branch into an air heat exchanger 4 and a nitrogen heat exchanger 5, in which it has heat exchange respectively with waste gas and nitrogen gas so that the resulting feed air is cooled down to about −170° C. The cooled air enters a rectifying column 6 in which it is rectified.

The air heat exchanger 4 is such that a nitrogen gas passage is omitted in the heat exchanger in the prior art for the heat exchange between the feed air and the low-temperature return gas. On the other hand, the nitrogen heat exchanger 5 is an independent heat exchanger for effecting heat exchange between the feed air and the nitrogen gas.

The feed air is subjected to rectifying separation in the rectifying column 6. Liquid air at an oxygen concentration of about 33 % containing high-boiling components such as carbon dioxide, hydrocarbon and moisture accumulates at the bottom of the column 6, and it is taken off by a pipe 21 and has its pressure reduced to about 4.6 kg/cm$^2$G by a valve 31. Thereafter, the liquid air is introduced into the liquid receiver of a main nitrogen condenser 7. This liquid air is gasified by the main nitrogen condenser 7 into waste gas, which is introduced into the air heat exchanger 4 and an expansion turbine 8 through a pipe 22. After being adiabatically expanded substantially to the atmospheric pressure, the waste gas has its temperature raised or restored to normal temperature through the air heat exchanger 4 and is emitted therefrom into the atmospheric air.

The nitrogen gas of high purity having been rectified by the rectifying column 6 and having ascended from the lower part thereof is passed via a pipe 23 so as to have heat exchange with the liquid air in the main nitrogen condenser 7 and is thereby converted into liquid nitrogen. The liquid nitrogen is recycled into a top of the lower part or stage of the rectifying column 6 through a pipe 24, thereby to provide a descending liquid within the column. Hydrogen which is a low-boiling component mixes in the nitrogen gas at the top of the rectifying column 6, and it is gradually enriched. In order to prevent the enrichment of the hydrogen content, a small amount of gas is blown from the top of the lower stage of the rectifyer via a pipe 30. Further, a pipe 25 for taking out nitrogen is connected to a position of the rectifying column 6 which is lower than the top thereof in the number of rectifying stages necessary for the rectification of the hydrogen content. However, even when the enrichment of the hydrogen content is prevented using these means, it is difficult to make the hydrogen content below the concentration of hydrogen in the feed air which is sent into the lower or stage part of the rectifying column 6. Accordingly, even when the hydrogen content has been removed from the atmospheric air by the $CO/H_2$ catalyzer 2, hydrogen on the order of 100-200 ppb is contained in the nitrogen gas at the upper part or stage of the rectifying column 6. In the liquid nitrogen, however, the content of hydrogen becomes about 1/20 relative to the nitrogen gas owing to the vapor-liquid equilibrium of hydrogen, so that the hydrogen contained in the liquid nitrogen is on the order to only 10 ppb or less.

Nitrogen to serve as a product is taken from the top of the lower stage of the rectifying column 6 through the pipe 25 in a state of liquid nitrogen with a low hydrogen content as described above, and it is introduced into CO-adsorbers 9. Carbon monoxide which cannot be separated by the rectification because the boiling point thereof is close to that of nitrogen is adsorbed and removed to an order of several ppb by the CO-adsorbers 9. Part of the liquid nitrogen emerging from the CO-adsorbers 9 is extracted as the superpure liquid nitrogen product, while the rest is passed through a pipe 26 into a sub nitrogen condenser 10 in which it is entirely gasified. A part of the nitrogen gas which is sent from the top of the rectifying column 6 into the main nitrogen condenser 7 through the pipe 23 is used as the heating source for the sub nitrogen condenser 10, and liquid nitrogen liquefied in the sub nitrogen condenser 10 is brought back into the top of the lower part of the rectifying column 6. Incidentally, for the purpose of the heat exchange in the sub nitrogen condenser 10, the liquid nitrogen to serve as a gas product has its pressure reduced from about 9 $kg/cm^2G$ to about 8.4 $kg/cm^2G$ by a valve 32. This pressure is controlled so as to be constant by a pressure controller 33 which is provided at the outlet of the sub nitrogen condenser 10.

After the gasification in the sub nitrogen condenser 10, the nitrogen gas has its temperature resumed to normal temperature by heat exchange with the feed air in the nitrogen heat exchanger 5. This nitrogen gas is taken out of the apparatus through a pipe 27, and is passed through a particle filter 11. The resulting gas is extracted as the superpure nitrogen gas product.

In starting the nitrogen producing apparatus, the feed air is supplied into only the air heat exchanger 4 and is cooled down to about −170° C. so as to supply the cooled air into the rectifying column 6, and the nitrogen heat exchanger 5 is not operated and is held at normal temperature. At the point of time at which nitrogen containing little impurities has been produced at the upper part of the rectifying column 6 owing to the stabilized rectifying operation of the rectifying column 6, a valve 35 is opened (a valve 38 having been closed) and nitrogen gas taken from a pipe 28 at the upper part of the rectifying column 6 and passed through a baking heater 12 begins to flow into the product nitrogen lines, whereupon the heater power source of the baking heater 12 is turned on. The nitrogen gas of little impurities heated from about −170° C. near to about 200° C. by the baking heater 12 is caused to flow through the piping, valve etc. of the superpure product nitrogen gas line including the CO-adsorbers 9, sub nitrogen condenser 10 and nitrogen heat exchanger 5, whereby sufficient hot-blast baking is carried out. Likewise, the hot-blast baking of the superpure product liquid nitrogen line is carried out.

At the point of time at which the hot-blast baking has completed the removal of outgases such as moisture in the product nitrogen lines, the heater power source of the baking heater 12 is turned off, and the cooling of the product nitrogen lines is started. When the cooling operation has proceeded, the feed air is allowed to flow into the nitrogen heat exchanger 5. When the cooling has been completed the valve 35 is closed, then the valve is opened and, the extraction of the product nitrogen (liquid) from the pipe 25 at the upper part of the rectifying column 6 is started, and the baking nitrogen gas having been kept flowing through the pipe 28 as well as the baking heater 12 from the rectifying column 6 is completely stopped flowing. Then, the apparatus leads to its normal operation.

According to this embodiment, the impurities to be contained in the product nitrogen can be lessened. As a further effect, since the baking is completed using the nitrogen gas of very high purity, a superpure nitrogen gas hardly containing outgases can be produced during the normal operation.

Now, another embodiment of the present invention will be described with reference to FIG. 2. As compared with the apparatus in the flow sheet of FIG. 1, a construction in FIG. 2 differs in that a pipe 29 and valve 34 are additionally provided. More specifically, the embodiment in FIG. 2 consists in that oxygen-rich liquid air is taken from the rectifying column and is used for subjecting the inner surfaces of product nitrogen lines to hotblast oxidation baking, whereby oxide films are formed on the inner surfaces to prevent outgases from being emitted after the baking.

Figure 2:
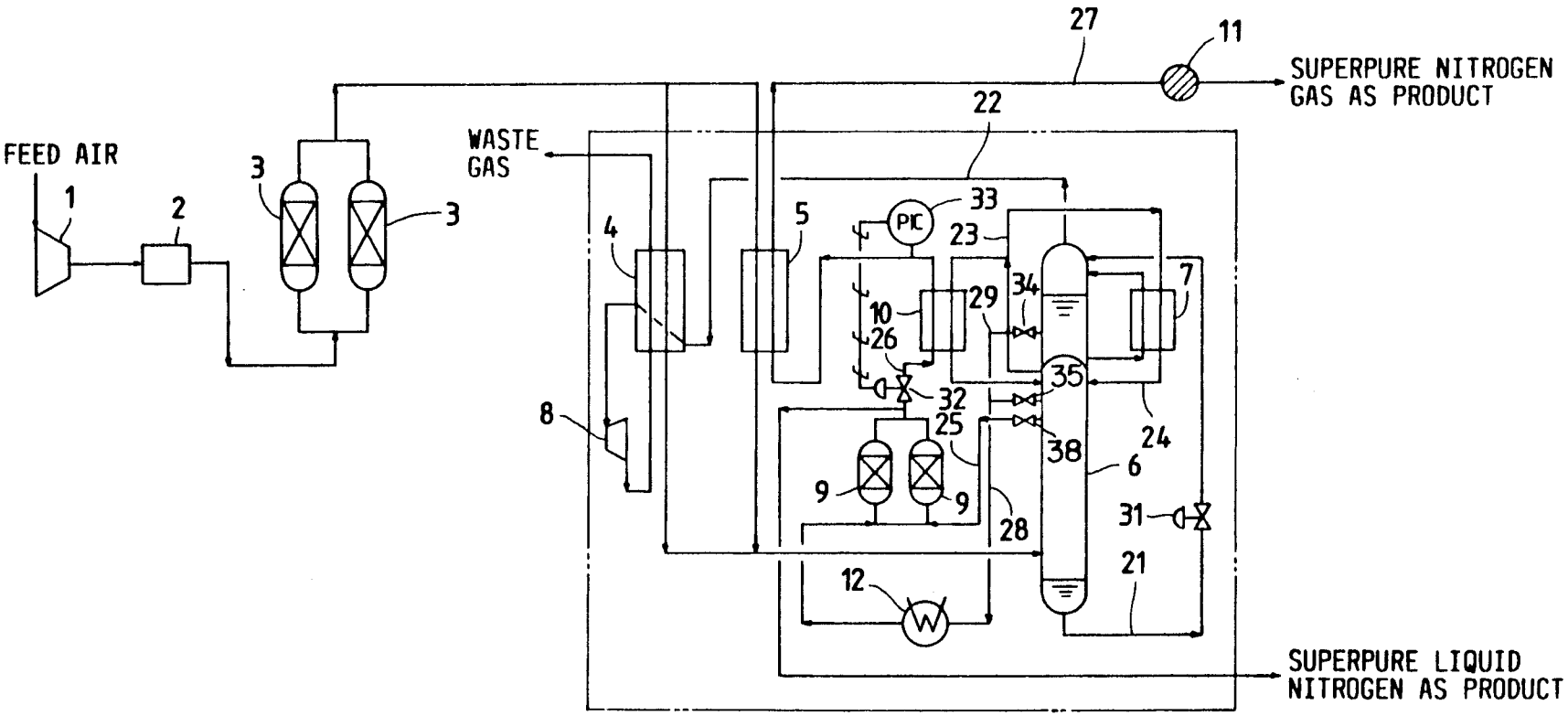
FIG. 2 is a flow sheet of an apparatus for producing superpure nitrogen in another embodiment of the present invention.

In starting the nitrogen producing apparatus in FIG. 2, accordingly, feed air is sent into only an air heat exchanger 4 and is cooled down to about −170° C. so as to supply the cooled air into the rectifying column 6, and a nitrogen heat exchanger 5 is not operated and is held at normal temperature. At the point of time at which a liquid has accumulated up to a rated level in the liquid air receiver of the rectifying column 6, the valve 34 of the liquid air receiver of the rectifying column 6 is opened, and the oxygen-rich liquid air is taken from the pipe 29 and is allowed to flow into the product nitrogen lines, whereupon the heater power source of a baking heater 12 is turned on. The oxygen-rich gas heated from about −170° C. near to about 200° C. by the baking heater 12 is caused to flow through the piping, valve etc. of the superpure product nitrogen gas line including CO-adsorbers 9, a sub nitrogen condenser 10 and the nitrogen heat exchanger 5, whereby sufficient hot-blast oxidation baking is carried out. Likewise, the hot-blast oxidation baking is carried out for the superpure product liquid nitrogen line.

After the above operation has been performed, the valve 34 is closed to stop the delivery of the liquid air.

Subsequently, the valve 35 is opened, and hot-blast baking with nitrogen from a pipe 28 is carried out to clean the surfaces The hot-blast oxidation baking with the liquid air and the hot-blast baking with the nitrogen gas are performed several times (in general, two or three times or so), thereby to form the oxide films of the inner surfaces and to reform the surfaces.

At the point of time at which the hot-blast baking has completed the removal of the outgases such as moisture in the product nitrogen lines, the heater power source of the baking heater 12 is turned off, and the cooling of the product nitrogen lines is started. When the cooling operation has proceeded, the feed air is begun to flow into the nitrogen heat exchanger 5. When the cooling has been completed, the extraction of product nitrogen (liquid) from pipe 25 at the upper part of the rectifying column 6 is started, and the baking nitrogen gas having been kept flowing through the pipe 28 as well as the baking heater 12 from the rectifying column 6 is completely stopped. Then, the apparatus shifts to its normal operation. By the way, although the hot-blast oxidation baking which employs the oxygen-rich liquid air purified in the rectifying column has been described in this embodiment, part of the feed air to be supplied into the rectifying column or an oxygen-containing fluid (for example, a waste gas or the feed air) taken from the rectifying column may well be used for the hot-blast oxidation baking as an alternatively way.

According to this embodiment, the inner surfaces of the piping and the devices are baked with hot blasts by the use of oxygen or the oxygen-rich gas, whereby the oxide films can be formed on the inner surfaces, and the inner surfaces can be brought into a so-called "seasoned" state.

Thus, the embodiment has the effect that the outgases composed principally of moisture, carbon monoxide and hydrogen, which develop from the piping, the devices etc. after the hot-blast baking, can be reduced.

The above embodiment has referred to the apparatus which employs the CO-adsorbers for the adsorption removal of carbon monoxide. However, it is also possible to construct a superpure-nitrogen producing apparatus without using CO-adsorbers.

Now, another embodiment of the present invention will be described with reference to FIG. 3. In this embodiment nitrogen gas of a low temperature taken from a rectifying column is heated to a high temperature of about 200° C. so as to perform the hot-blast baking of a product nitrogen line, thereby to remove outgases such as moisture contained in the product nitrogen line.

Figure 3:
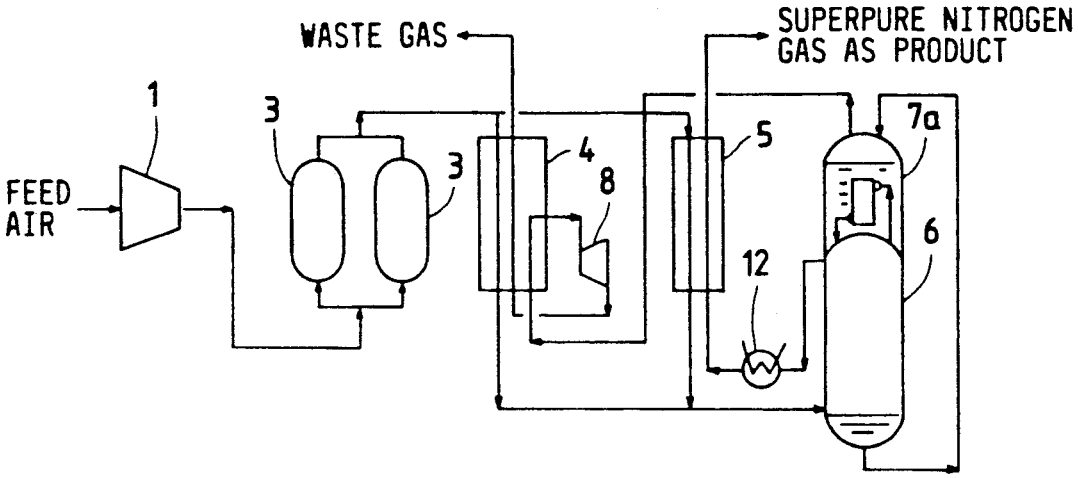
FIG. 3 is a flow sheet of an apparatus for producing superpure nitrogen in still another embodiment of the present invention.
Figure 5:
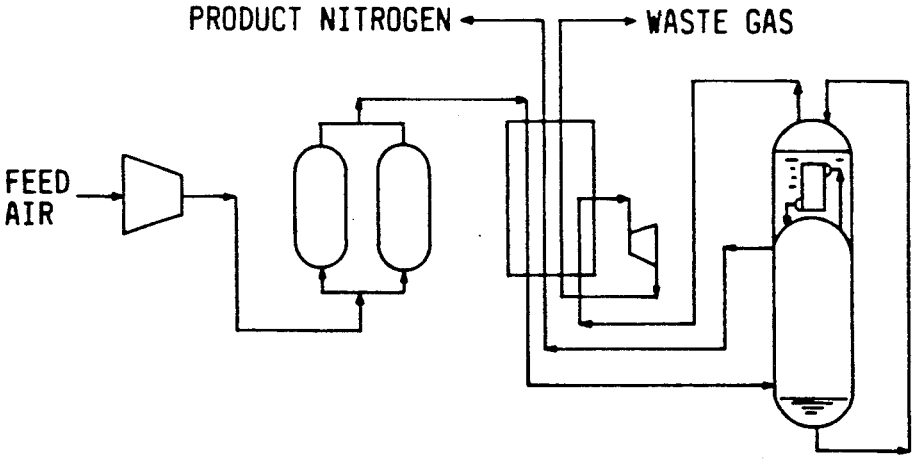
FIG. 5 is a flow sheet of a prior art apparatus for producing nitrogen.

Referring to FIG. 3, feed air taken in from the atmospheric air is compressed to about 9 kg/cm$^2$G by an air compressor 1, and the compressed air is introduced into adsorbers 3 where moisture and carbonic acid gas are removed by adsorption. The resulting feed air from the adsorbers 3 is bifurcated to branch into an air heat exchanger 4 and a nitrogen heat exchanger 5, in which it is heat exchanged respectively with waste gas and nitrogen gas so as to be cooled down to about −170° C. The cooled air enters the rectifying column 6 in which the air is rectified.

Liquid air which contains high-boiling impurities such as oxygen, carbon dioxide, hydrocarbon and moisture accumulates at the bottom of the rectifying column 6, and it is gasified into waste gas by a nitrogen condenser 7*a*. The waste gas has its temperature restored to the normal temperature through an expansion turbine 8 as well as the air heat exchanger 4, from which it is discharge into the atmospheric air.

The nitrogen gas having little impurities taken from the upper part of the rectifying column 6 has its temperature raised to the normal temperature through a baking heater 12 as well as the nitrogen heat exchanger 5. The resulting nitrogen gas is obtained as the product nitrogen gas cf very high purity.

In starting the nitrogen producing apparatus, the feed air is introduced into only the air heat exchanger 4 and is cooled down to about −170° C. Since the nitrogen heat exchanger 5 is operated with its feed air inlet valve fully closed, it is held at the normal temperature.

At the point of time at which nitrogen containing little impurities has been produced at the upper part of the rectifying column 6 owing to the stabilized rectifying operation of this column, the nitrogen gas is allowed to flow into the product nitrogen line, and the heater power source of the baking heater 12 is turned on so as to heat the nitrogen gas from about −170° C. to about 200° C. Thus, the hot-blast baking of the nitrogen heat exchanger 5, piping, valve etc. is performed with the heated nitrogen gas.

At the point of time at which the hot-blast baking has completed the removal of the outgases such as moisture, the heater power source of the baking heater 12 is turned off, and the feed air is allowed to flow for the heat exchange between the feed air and the nitrogen gas. Then, the apparatus is returned its normal operation.

Incidentally, hot-blast oxidation baking based on a baking gas containing oxygen is also permitted by starting the hot-blast baking before the rectifying operation of the rectifying column 6 is conducted.

According to this embodiment, the superpure nitrogen having a low content of outgases such as moisture can be produced during the normal operation.

Now, still another embodiment of the present invention will be described with reference to FIG. 4. In this embodiment, after carbon monoxide in the liquid nitrogen is removed by CO-adsorption, particles are removed through a filter, whereupon hydrogen is separated by rectification.

Figure 4:
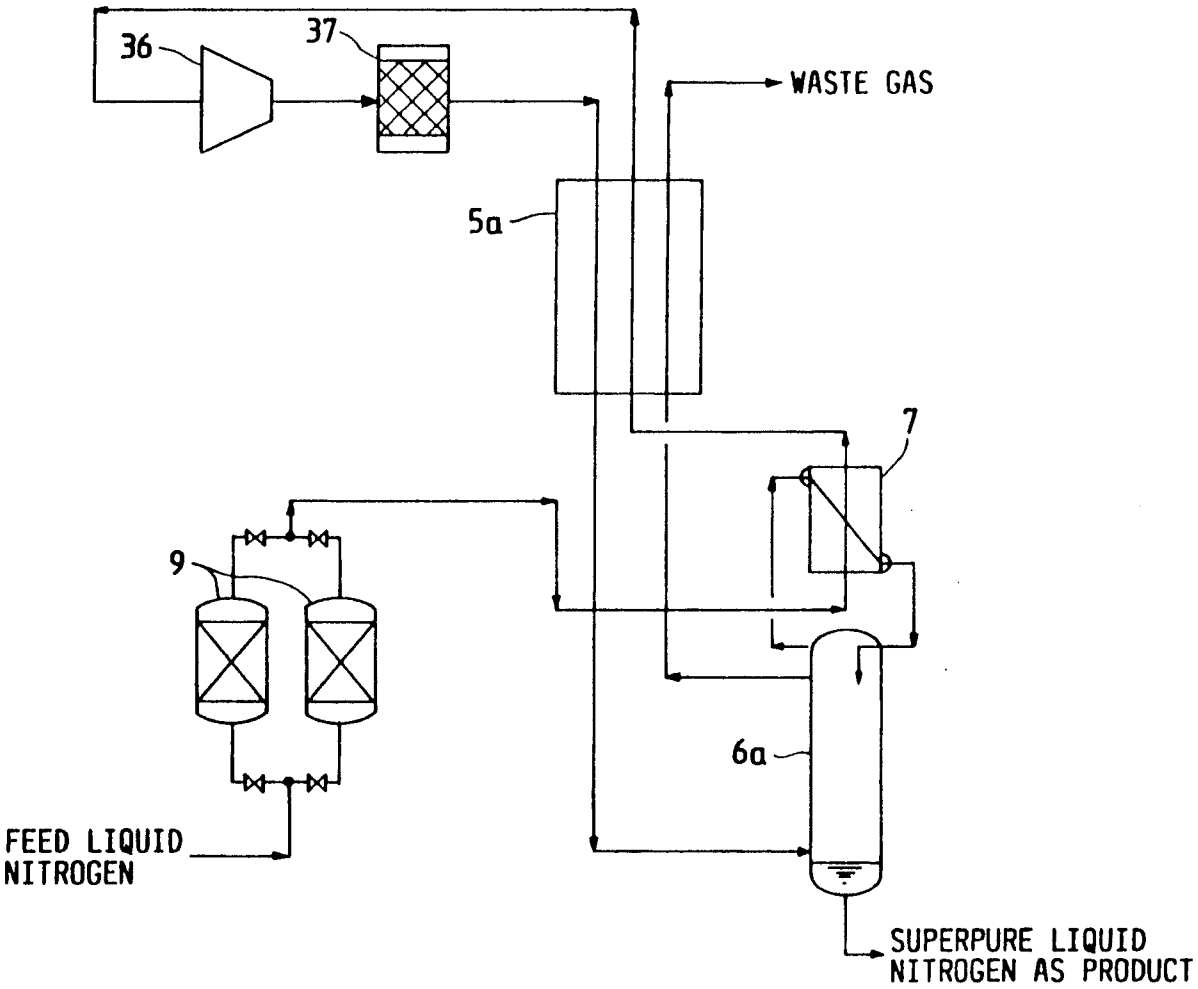
FIG. 4 is a flow sheet of an apparatus for producing superpure nitrogen in yet another embodiment of the present invention.

Referring to FIG. 4, feed liquid nitrogen supplied from outside or liquid nitrogen supplied from the rectifying column shown in FIG. 1-3 is introduced into CO-adsorbers 9, in which carbon monoxide is chiefly removed by the co-adsorption of low temperature. The feed liquid nitrogen with the carbon monoxide adsorbed and removed therefrom is subjected to heat exchange with the ascending gas of a nitrogen purifying column 6*a* (a rectifying column) in a nitrogen condenser 7 until it is vaporized and gasified. The gas is passed through a nitrogen heat exchanger 5*a* in which it is heated to normal temperature. The nitrogen gas at the normal temperature is boosted to a predetermined pressure in a nitrogen booster 36, and has particles removed therefrom in the particle filter 37. Thereafter, the nitrogen gas is cooled near to its liquefying point in the nitrogen heat exchanger 5*a*, and it is supplied into the nitrogen purifying column 6*a* (rectifying column). In the process of ascending within the nitrogen purifying column 6*a* (rectifying column), the nitrogen gas comes into contact with a circulating liquid from above, and $H_2$ being a low-boiling component is chiefly separated therefrom by rectification. The ascending gas is condensed by the heat exchange with the feed liquid nitrogen in the nitrogen condenser 7, thereby into the circulating liquid of the nitrogen purifying column 6a (rectifying column). This liquid descends within the column 6a, and is obtained as product liquid nitrogen through a liquid receiver provided at the lower part of the column. A waste gas whose principal component is the $H_2$ subjected to the rectifying separation, is drawn out of the upper part of the nitrogen purifying column 6a (rectifying column) and is discharged into the atmospheric air after being heated to normal temperature by the nitrogen heat exchanger 5a.

According to this embodiment, carbon monoxide can be chiefly removed by the CO-adsorbers, particles by the particle filter, and hydrogen by the nitrogen purifying column. It is therefore possible to obtain a nitrogen product of very high purity in which the content of each of the impurities, carbon monoxide and hydrogen is on the order of several ppb and in which the density of particles of 0.1 μm is on the order of several particles/$ft^3$.

Effects of the Invention

As thus far described, according to the present invention, a product nitrogen line is subjected to baking by heating nitrogen gas of low temperature which contains very little impurities such as moisture little, so that superpure nitrogen having a water content of 1 ppb or less can be produced.

Besides, product nitrogen is obtained in a liquid state and is gasified to obtain the product nitrogen gas, whereby the content of hydrogen being a low-boiling component, can be decreased to 10 ppb or less.

Moreover, since the product nitrogen is adsorbed at a low temperature directly in the liquid state, the content of carbon monoxide in the product nitrogen gas as well as the liquid nitrogen can be decreased to several ppb.

Further, the hot-blast baking of the product nitrogen line is performed with an oxygen-containing gas at a temperature near about 200° C., whereby impurities ascribable to outgases from the product nitrogen line can be prevented from mixing with the product.

As described above, according to the present invention, impurities to be contained in product nitrogen can be lessened extraordinarily. Further, it is possible to produce superpure nitrogen which prevents the product nitrogen gas from being polluted with outgases of lines, valves, etc.

We claim:

1. A method of producing superpure nitrogen comprising the steps of subjecting a feed gas, which contains nitrogen, to heat exchange with a return gas of low temperature and then introducing it into a rectifying column; heating nitrogen, which has undergone rectifying separation in the rectifying column to a temperature at which moisture can be removed; subjecting lines of product nitrogen to hot-blast baking with said heated nitrogen; and after completion of said hot-blast baking, stopping said heating to obtain superpure nitrogen which has undergone rectifying separation.

2. A method of producing superpure nitrogen as defined in claim 1, wherein said superpure nitrogen is obtained by the steps of deriving nitrogen, which has undergone rectifying separation in the rectifying column, in the form of a liquid; heating and gasifying at least part of the derived liquid nitrogen; and subjecting said gasifying nitrogen to heat exchange with the feed gas, thereby to obtain a nitrogen gas of very high purity as a product.

3. A method of producing superpure nitrogen as defined in claim 1, wherein said superpure nitrogen is obtained by the steps of deriving nitrogen, which has undergone rectifying separation in the rectifying column, in the form of a liquid and then removing carbon monoxide therefrom through absorption at a low temperature, thereby to obtain part of the liquid nitrogen as a product; heating and gasifying the rest of the liquid nitrogen; and subjecting said gasifying nitrogen to heat exchange with the feed gas, thereby to obtain a nitrogen gas of very high purity as a product.

4. A method of producing superpure nitrogen as defined in claim 3, wherein said feed gas containing nitrogen is air.

5. A method of producing superpure nitrogen as defined in claim 3, wherein the liquid nitrogen product and the nitrogen gas product are obtained after deriving and heating the nitrogen gas, which has undergone the rectifying separation in said rectifying column through hot-blast baking, and subjecting lines of said liquid nitrogen product and said nitrogen gas product to hot-blast baking with the heated nitrogen gas.

6. A method of producing superpure nitrogen as defined in claim 3, wherein the liquid nitrogen product and the nitrogen gas product are obtained after deriving and heating either the feed gas to be supplied into said rectifying column or an oxygen-containing fluid subjected to the rectifying separation in said rectifying column before said hot-blast baking, and subjecting lines of said liquid nitrogen product and said nitrogen gas product to hot-blast oxidizing baking with either the heated feed gas or fluid.

7. A method of producing superpure nitrogen as defined in claim 5 ,wherein the hot-blast baking of said lines of said liquid nitrogen product and said nitrogen gas product are performed with the nitrogen gas subjected to the rectifying separation in said rectifying column, after hot-blast oxidizing baking with oxygen-rich liquid air subjected to the rectifying separation in said rectifying column.

8. A method of producing superpure nitrogen as defined in claim 5 ,wherein the hot-blast baking of said lines of said liquid nitrogen product and said nitrogen gas product are performed with the nitrogen gas subjected to the rectifying separation in said rectifying column, after hot-blast oxidizing baking with either the feed gas to be supplied into said rectifying column or an oxygen-containing fluid subjected to the rectifying separation in said rectifying column.

9. A method of producing superpure nitrogen as defined in claim 1, wherein said superpure nitrogen is obtained by the steps of heating either the feed gas to be supplied into the rectifying column or an oxygen-containing fluid subjected to rectifying separation in said rectifying column to perform hot-blast oxidizing baking of a product nitrogen gas line; further performing hot-blast baking with the nitrogen gas subjected to rectifying separation in the rectifying column; and after completion of the hot-blast baking, subjecting a gasified nitrogen to heat exchange with the feed gas and product nitrogen subjected to the rectifying separation in said rectifying column, thereby to produce a nitrogen of very high purity.

10. A method of producing superpure nitrogen as defined in claim 1, wherein said superpure nitrogen is obtained by the steps of heating a nitrogen gas, which has undergone rectifying separation in the rectifying column to perform hot-blast baking of a product nitrogen line; and after completion of the baking, subjecting a gasified nitrogen to heat exchange with the feed gas and product nitrogen subjected to the rectifying separation in said rectifying column, thereby to produce a nitrogen of very high purity.

11. A method of producing superpure nitrogen as defined in claim 10, wherein said feed gas containing nitrogen is air.

12. A method of producing superpure nitrogen as defined in claim 10, wherein the hot-blast baking of said product nitrogen line is performed with the nitrogen gas subjected to the rectifying separation in said rectifying column, after hotblast oxidizing baking with either the feed gas to be supplied into said rectifying column or an oxygen-containing fluid subjected toe the rectifying separation in said rectifying column.

13. A method of producing superpure nitrogen as defined i claim 1, wherein said superpure nitrogen is obtained by steps of supplying a feed gas from the atmosphere, which contains nitrogen, in liquid form; removing carbon monoxide in the feed liquid nitrogen by low-temperature adsorption, and then subjecting the liquid nitrogen to heat exchange with an ascending gas in a rectifying column, to change the liquid nitrogen into a nitrogen gas of normal temperature; and removing particles in the nitrogen gas in a boosted state, and cooling the nitrogen gas to liquefy the nitrogen gas again to separate hydrogen by rectification, thereby to obtain a liquid nitrogen of very high purity as a product.

14. An apparatus for producing superpure nitrogen comprising a heat exchanger in which a feed gas containing nitrogen is subjected to heat exchange with a return gas of low temperature, a rectifying column in which the feed gas cooled by said heat exchanger is liquefied and subjected to rectifying separation, and a means for heating nitrogen which has undergone rectifying separation in the rectifying column to a temperature at which moisture of a product nitrogen line can be removed so as to perform hot-blast baking of the line, thereby to produce nitrogen of very high purity.

15. An apparatus for producing superpure nitrogen as defined in claim 14, wherein a structure for producing the superpure nitrogen comprises a sub-nitrogen condenser in which at least part of the liquid nitrogen taken from said rectifying column is gasified, and a heat exchanger in which the nitrogen gas resulting from the gasification in said sub-nitrogen condenser is subjected to heat exchange with the feed gas so as to heat the nitrogen gas.

16. An apparatus for producing superpure nitrogen as defined in claim 14, wherein a structure for producing the superpure nitrogen comprises a CO-adsorber assembly by which the liquid nitrogen having undergone the rectifying separation in said rectifying column is treated to adsorb and remove carbon monoxide contained in the liquid nitrogen, a sub-nitrogen condenser which gasifies at least part of the liquid nitrogen with the carbon monoxide removed therefrom by the adsorption, a heater for heating gaseous nitrogen having undergone the rectifying separation in said rectifying column, before the gaseous nitrogen is introduced into said CO-adsorber assembly, and a heat exchanger in which the nitrogen gas resulting from the gasification in said sub-nitrogen condenser is subjected to heat exchange with the feed gas to heat the nitrogen gas.

17. An apparatus for producing superpure nitrogen as defined in claim 16, wherein said feed gas containing nitrogen is air.

18. An apparatus for producing superpure nitrogen as defined in claim 16, wherein a port for drawing out said liquid nitrogen which has undergone the rectifying separation in said rectifying column is provided in that part of said rectifying column which is several stages lower than an uppermost stage thereof.

19. An apparatus for producing superpure nitrogen as defined in claim 16, wherein part of said nitrogen gas having undergone the rectifying separation in said rectifying column is used as a heating source for said liquid nitrogen, and a product nitrogen line coupled to said sub nitrogen condenser has its pressure reduced.

20. An apparatus for producing superpure nitrogen as defined in claim 16, wherein said heat exchanger for heat exchange between said nitrogen gas and said feed gas is arranged in isolation from said heat exchanger for the heat exchange between the return waste gas of low temperature and said feed gas.

21. An apparatus for producing superpure nitrogen as defined in claim 16, wherein said means for heating the gaseous nitrogen includes a baking heater for heating said gaseous nitrogen to a temperature at which moisture can be removed.

22. An apparatus for producing superpure nitrogen as defined in claim 16, wherein a pipe which derives oxygen-rich liquid air having undergone the rectifying separation in said rectifying column is coupled to a pipe along which the gaseous nitrogen having undergone the rectifying separation in said rectifying column is heated and then introduced into said CO-adsorber assembly, through valves and upstream of the heating means.

23. An apparatus for producing superpure nitrogen as defined in claim 16, wherein a pipe which either the feed gas to be supplied into said rectifying column or an oxygencontaining fluid having undergone the rectifying separation in aid rectifying column, is coupled to a pipe along which the gaseous nitrogen having undergone the rectifying separation in said rectifying column is heated and then introduced into said CO-adsorber assembly, through a valve and upstream of the heating means.

24. An apparatus for producing superpure nitrogen as defined in claim 21, wherein the apparatus comprises a conduit by which the nitrogen gas passed via said baking heater is introduced into a regeneration line of said CO-adsorber assembly.

25. An apparatus for producing superpure nitrogen as defined in claim 21, wherein a structure for producing the superpure nitrogen comprises a baking heater by which a nitrogen gas line extending from an outlet of said rectifying column is subjected to hot-blast baking, and a nitrogen heat exchanger in which the feed gas and nitrogen gas having undergone the rectifying separation in said rectifying column are subjected to heat exchange and which is located downstream of said baking heater.

26. An apparatus for producing superpure nitrogen as defined in claim 25, wherein said feed ga containing nitrogen is air.

27. An apparatus for producing superpure nitrogen as defined in claim 25, wherein a pipe which either the feed gas to be supplied into said rectifying column or an oxygencontaining fluid having undergone the rectifying separation in said rectifying column is coupled to said baking heater for the hot-blast baking, through a valve and upstream of said baking heater.

28. An apparatus for producing superpure nitrogen as defined in claim 14, wherein a structure for producing the superpure nitrogen comprises a CO-adsorber assembly which is inserted in a pipe that supplies a nitrogen purifying column with a liquid nitrogen having undergone the rectifying separation from a nitrogen-containing feed gas, a booster which boosts nitrogen gas obtained by the heat exchange between the liquid nitrogen having passed through said CO-adsorber assembly and an ascending gas of a nitrogen rectifying column by a nitrogen condenser, a nitrogen heat exchanger for the heat exchange between the nitrogen gas of normal temperature with particles removed from the nitrogen gas boosted by said booster and a return gas of low temperature from the rectifying column, and a pipe for guiding the nitrogen gas to the nitrogen rectifying column after the nitrogen gas has been cooled and liquefied by said nitrogen heat exchanger.

* * * * *